US005515667A

United States Patent [19]

Röösli

[11] Patent Number: 5,515,667

[45] Date of Patent: May 14, 1996

[54] DEVICE FOR FORMING A STACK EXTENDING PERPENDICULAR TO THE STANDING, SEQUENTIAL PRINTED SHEETS

[75] Inventor: Hanspeter Röösli, Dagmersellen, Switzerland

[73] Assignee: GRAPHA-Holding AG, Hergiswil, Switzerland

[21] Appl. No.: 237,116

[22] Filed: May 3, 1994

[30] Foreign Application Priority Data

May 7, 1993 [CH] Switzerland ..... 1414/93

[51] Int. Cl.[6] ..... B65B 35/30

[52] U.S. Cl. ..... 53/542; 53/157; 53/176; 53/528; 53/529; 53/582

[58] Field of Search ..... 53/156, 157, 523, 53/528, 529, 531, 542, 589, 590, 591, 155, 580, 582, 176

[56] References Cited

U.S. PATENT DOCUMENTS

| | | | |
|---|---|---|---|
| 3,648,431 | 3/1972 | Hartbauer et al. | 53/542 X |
| 4,074,508 | 2/1978 | Reid | 53/542 X |
| 4,161,095 | 7/1979 | Buday | 53/542 X |
| 4,250,689 | 2/1981 | van Cutsem | 53/542 X |
| 4,292,785 | 10/1981 | Hammond | 53/542 X |
| 4,531,343 | 7/1985 | Wood | 53/542 X |
| 4,611,705 | 9/1986 | Fluck | 53/542 X |
| 4,641,489 | 2/1987 | Wood | 53/542 X |
| 4,765,451 | 8/1988 | Labombarde | 53/542 X |
| 4,828,101 | 5/1989 | Fluck | 53/542 X |
| 4,879,862 | 11/1989 | Nolte et al. | 53/542 X |

FOREIGN PATENT DOCUMENTS

| | | |
|---|---|---|
| 111432 | 6/1984 | European Pat. Off. . |
| 393820 | 12/1991 | European Pat. Off. . |

*Primary Examiner*—John Sipos
*Assistant Examiner*—Daniel Moon
*Attorney, Agent, or Firm*—Spencer & Frank

[57] ABSTRACT

A device for forming a stack of printed sheets. The device includes a conveying device for conveying the printed sheets in an imbricated flow vertically downwards and an approximately horizontal stack support disposed below the conveying device and having an entrance end for receiving the printed sheets. The stack support has a working region where stacks of the printed sheets are formed, and, disposed downstream of the working region in a stack formation direction, a pressing region where formed stacks of the printed sheets are compressed. The device also includes a guide arrangement disposed above the stack support and including two support mechanisms displaceably driven between the working region of the stack support and the pressing region of the stack support, such that, in the working region of the stack support, the support mechanisms serve as an insertion device for forming stacks by inserting an end plate at an end side of a stack of printed sheets, and, in the pressing region of the stack support, the support mechanisms serve as a jaw-type press for compressing a formed stack. The support mechanisms are further effective for conveying a formed stack from the working region of the stack support to the pressing region of the stack support. The device further includes a tying device operatively associated with the support mechanisms and disposed adjacent the pressing region of the stack support for tying a formed stack.

18 Claims, 6 Drawing Sheets

DEVICE FOR FORMING A STACK EXTENDING PERPENDICULAR TO THE STANDING, SEQUENTIAL PRINTED SHEETS

CROSS-REFERENCE TO RELATED APPLICATION

This application claims the priority of patent application Ser. No. CH 01414/93-5, filed May 7, 1993, in Switzerland, the subject matter of which is incorporated herein by reference.

BACKGROUND OF THE INVENTION

The invention relates to a device for forming a stack extending perpendicular to the standing, sequential printed sheets, comprising a conveying device that conveys the printed sheets in the form of an imbricated flow or sequential partial imbricated flows vertically from above to an approximately horizontal stack support, further comprising an insertion device disposed along the stack support configured for stack formation and that forms the length of a stack by means of end plates inserted at the end side, further comprising a downstream, jaw-type press that compresses the stack and is associated with a tying device.

SUMMARY OF THE INVENTION

In a rodlike, cantilever arm, or device for forming a stack from standing, sequential printed sheets, known as 327 and sold under the brand Miller Martini, the printed sheets are conveyed in partial imbricated flows, corresponding to the length of a stack to be formed, in a vertical conveying direction to a support comprising two parallel, endlessly circulating chains. The stack being formed by circulating belts and the horizontally driven surface is respectively defined on its front side and rear side by an end plate resting on support elements of the chain. In this relatively loose form the stack is displaced in the direction of its extension between two jaw parts of a press that presses the stack together from the ends and subsequently displaces them laterally for tying.

In another known device designated as 244, the stack formed on the circulating chains is pressed together from the chains by means of pressing jaws, lifted and displaced laterally in the pressed state for tying.

In these devices, the formation of the rod-like stack is associated with the division of the chains that receive the stack, that is, a change in the stack length is only possible with limitations and with a relatively high expenditure. Moreover, a plurality of discontinuous work steps are required that are to be executed in different directions and planes.

It is therefore an object of the invention to create a device that requires less space, and with which the above-described drawbacks can be avoided to a great extent.

In accordance with the invention, the object is attained in that a guide arrangement of two displaceably driven support mechanisms disposed as an insertion device for the end plates along the stack formation section is provided above the stack support extending in the working region of the press, which support mechanisms act as conveyors and are configured as the press that compresses the stack in the direction of extension on the following section of the stack support defined for tying.

The significant advantage is attained of uninterrupted conversion of the printed sheets conveyed in imbricated flows into compact, tied stacks on a short, linear processing segment.

BRIEF DESCRIPTION OF THE DRAWINGS

The device of the invention is described in detail below by way of an embodiment illustrated in the drawing figure.

DETAILED DESCRIPTION OF THE PREFERRED EMBODIMENT

Figure 1:
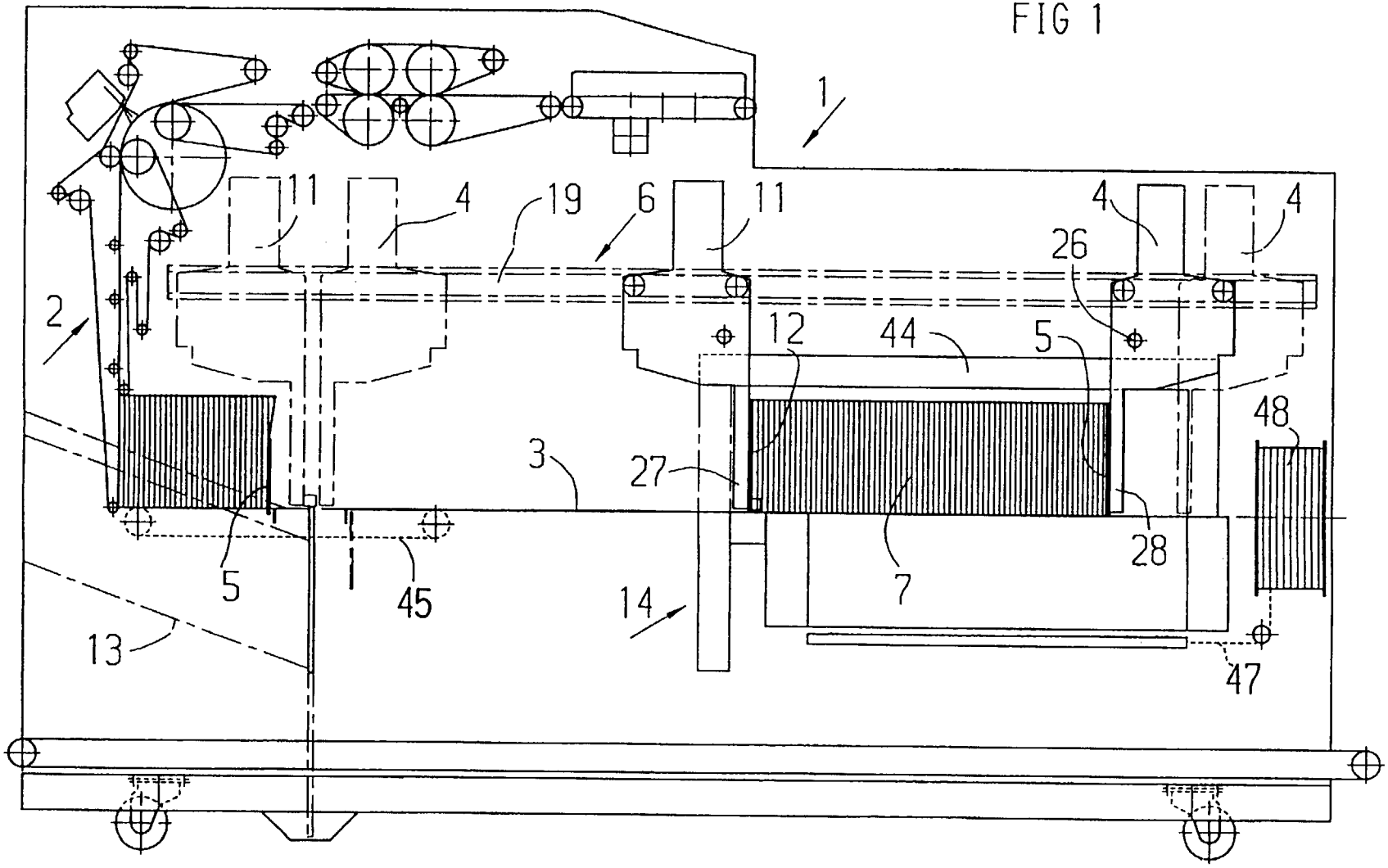
FIG. 1 is a schematic side view of a device of the invention.

FIG. 1 shows the device 1 of the invention for forming a stack extending perpendicular to the standing, sequential printed sheets.

Figure 2:
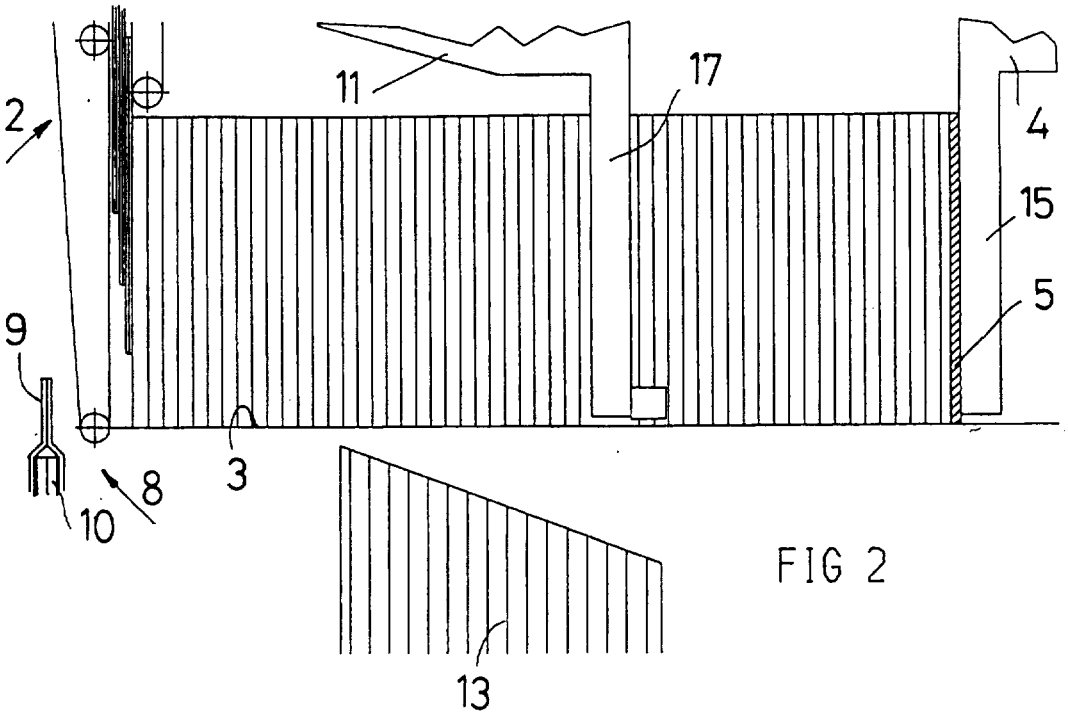
FIG. 2 is an enlarged schematic representation of the device of FIG. 1 in the charging region of the stack support.

In the present example, the printed sheets are conveyed from above in approximately the vertical direction to a horizontal stack support 3 via a conveying device 2, after being previously centered or aligned and the provided fold has subsequently been pressed, in the form of an imbricated flow or sequential, partial imbricated flows that determine the length of the stack to be produced. It is to be understood that, hereinafter, an imbricated flow is intended to refer to both a continuously imbricated flow and to sequential, partial imbricated flows. In a multiple-sheet configuration, the printed sheets are placed approximately vertically, with the fold in front, onto stack support 3 and accumulated on a displaceable support mechanism 4 located at the end of conveying device 2, and that supports the end plate 5 that forms the front end of the stack; support mechanism 4 is driven at the speed of the stack structure to a guide arrangement 6 that extends parallel to stack support 3. FIG. 2 illustrates this situation.

A separating device 8 next to the conveying end of conveying device 2 that can be activated outside the active stack support 3 is inserted between the two conveyed printed sheets as soon as the front sheet of the two is at least nearly located on stack support 3. This process is effected through a displacement of separating device 8 in the direction of stack formation, and can be improved with respect to reliability when a continuously imbricated flow is divided into partial imbricated flows by a gap formation device before reaching the conveying end of conveying device 2, or the spacing between two printed sheets is increased.

This means that care must be taken to make the dimension of separating elements 9 projecting beyond stack support 3 less than the imbrication spacing between two printed sheets.

Separating device 8 is disposed in pairs with spacing transverse to the direction of stack formation, and each separating device 8 in turn has two partial pairs formed from a separating element 9 and a support element 10, which partial pairs are disposed mirror-inverted opposite one another.

The insertion of separating device 8 between two printed sheets is effected with partial pairs lying against one another and righted separating elements 9, whereupon the formation of a single stack takes place at least in the lower region of the stacked printed sheets.

Figure 3:
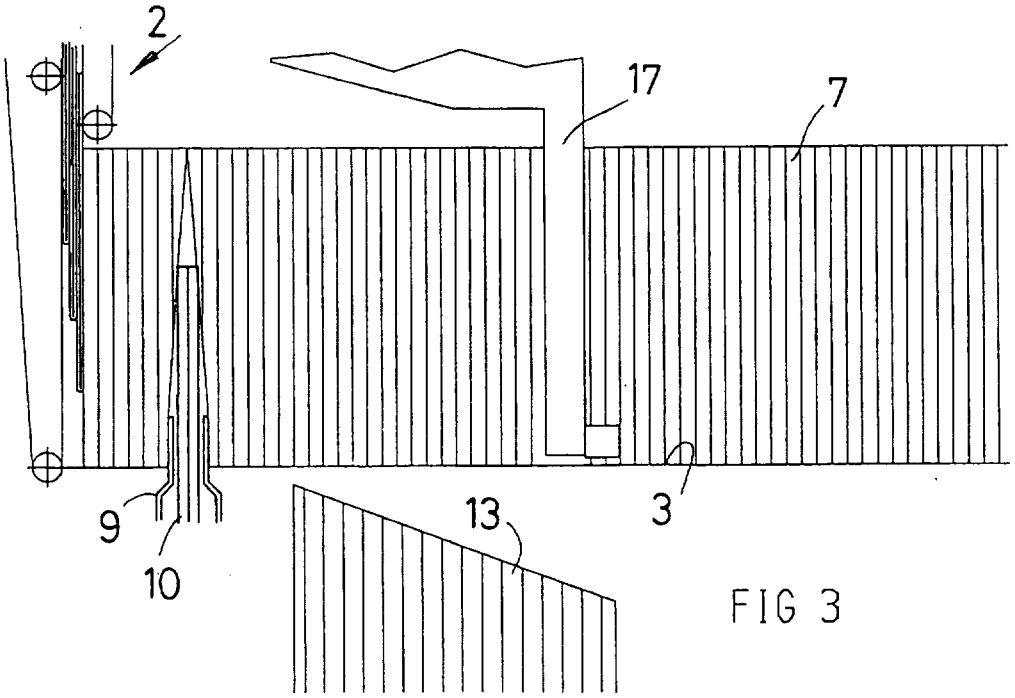
FIG. 3 illustrates a stack-forming situation that follows charging.

In the course of further stack formation, separating elements 9 are moved away from each other, forming a larger gap in stack 7. Subsequently the support elements 10 that accompany separating elements 9 are inserted so far into the gap that it can swiftly separate the resulting rear end of the stack preceding the front end of the following stack 7. FIG. 3 shows separating elements 9 and support elements 10 (as an aid) as being laterally displaced, although they are disposed approximately flush transversely to the stack movement direction.

Figure 4:
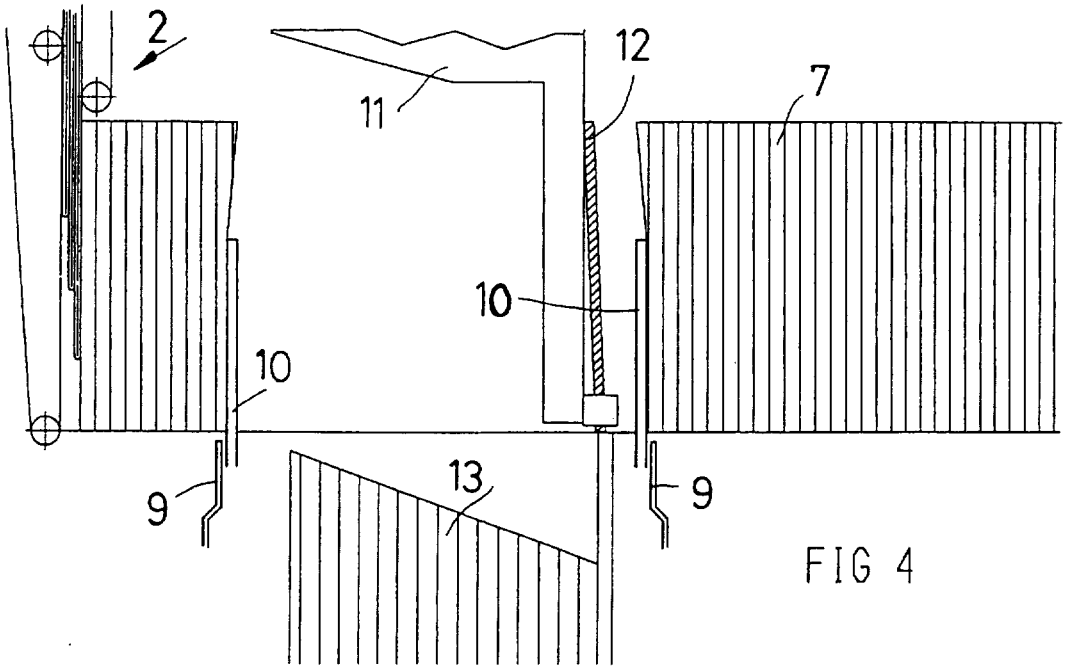
FIG. 4 illustrates an advanced stack-forming situation with respect to FIG. 3.

When support elements 10 are extended, separating elements 9 are pulled back out of stack 7, as illustrated in FIG. 4. While rear support elements 10 define the front end of a re-forming stack, front support elements 10 follow on the rear side of complete stack 7.

As shown in FIG. 1, stack support 3 can be configured, at least in the front region of the stack formation segment, by endlessly driven belts 45, so that optional precompression of stack 7 can be achieved.

The drive of belts 45 can be effected both independently of and as a function of the stack formation speed.

After a path is covered on stack support 3, an end plate 12 that forms the rear end of the preceding stack 7 is lifted out of a lateral hopper 13 by a further support mechanism 11, which, like support mechanism 4, is displaced on guide arrangement 6. The end plate is then installed behind stack 7, leaning slightly against support elements 10. Support elements 10 can thus be lowered beneath stack support 3, whereupon stack 7 rests with its rear side against end plate 12. FIG. 4 illustrates the temporary lifting of end plate 12 out of a plate hopper 13 to approximately the height of stack support 3.

In the interim, after being transported further, stack 7 is pressed together by support mechanisms 4 and 11, which are transporting it, and subsequently tied in a tying device 14 disposed at the end of stack support 3 (FIG. 1).

The tied stack 7 is then displaced onto a lateral transport device with the aid of support mechanisms 4 and 11.

Figure 5:
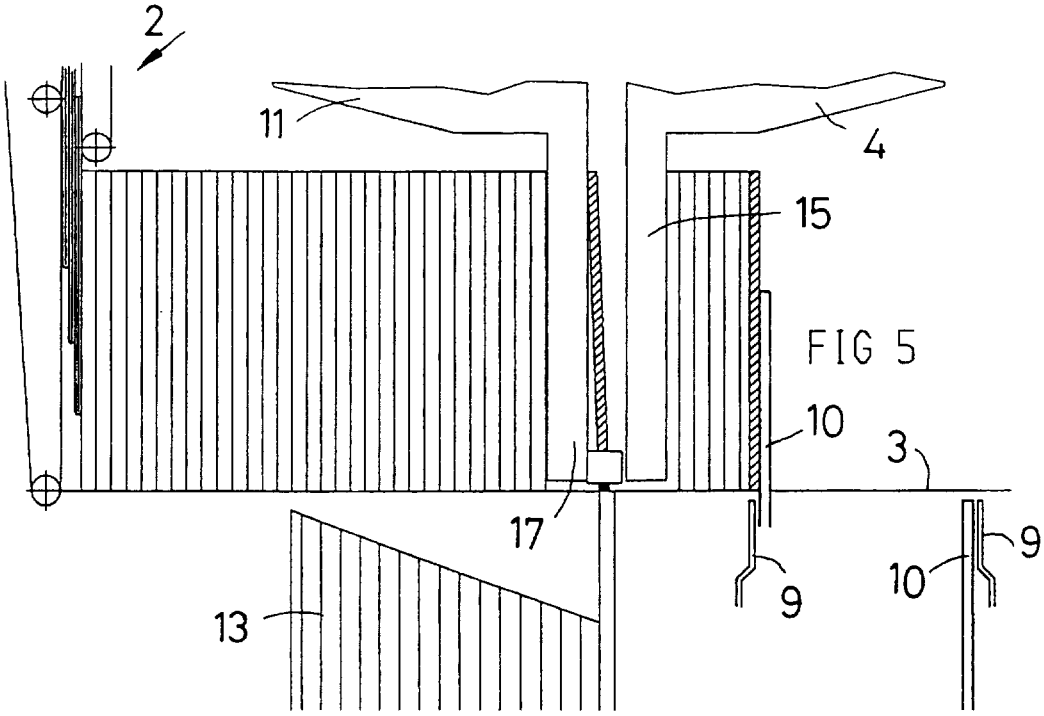
FIG. 5 illustrates the return situation of the support mechanisms.

Support mechanisms 4 and 11 are subsequently displaced back on guide arrangement 6 into the region of a newly-forming partial stack, as shown in FIG. 5. In the interim, support mechanisms 4 and 11 have received on their side facing hopper 13 an end plate 5 that is specified for the front end of stack 7 in production, and they displace this plate to the front side of the continuously forming stack 7.

Figure 6:
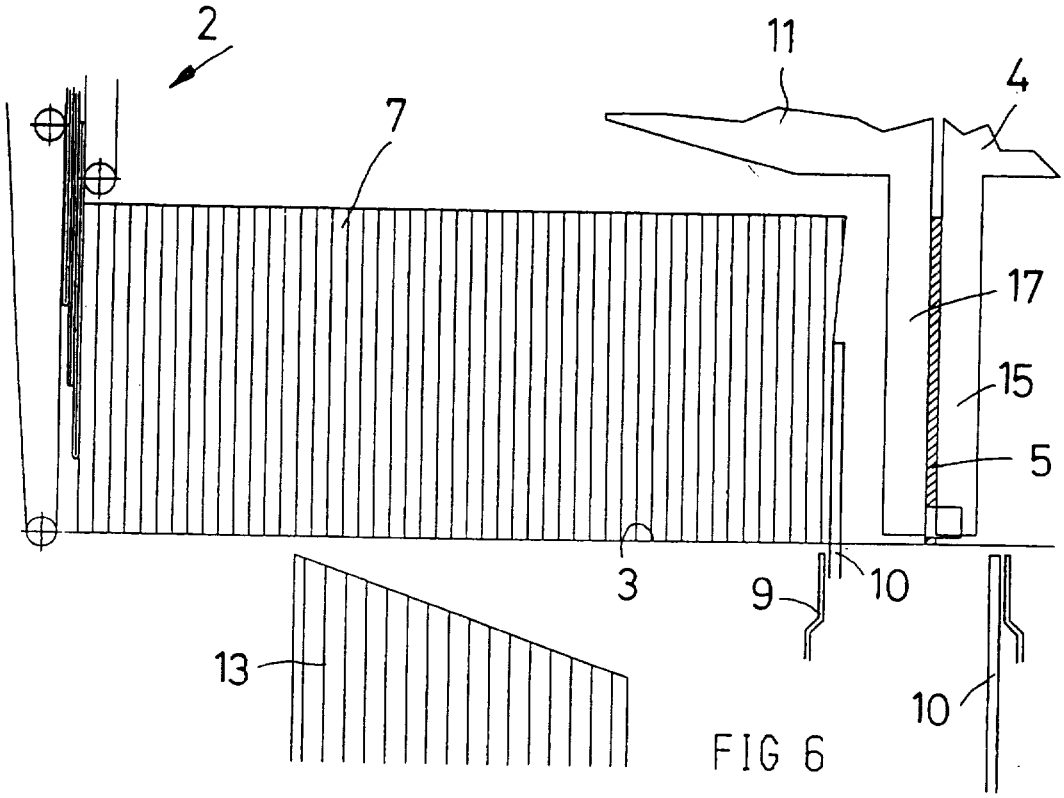
FIG. 6 represents a further work step of stack formation.

FIG. 6 illustrates the last work step, in which end plate 5 is displaced transversely to stack support 3 in front of the partial stack so that the support elements 10 on the front side of the partial stack can be lowered directly afterward beneath stack support 3.

Afterward, support mechanism 11 is returned to the position of the end plate hopper 13 for receiving end plates. It must be added that support mechanisms 4, 11 each have a pressure plate pair 15, 16, 17, 18 that is laterally displaceable from stack support 3; pressure plates 15, 17 facing end plate hopper 13 are additionally specified for removal from or installation of end plates 12 into the stack.

Figure 7:
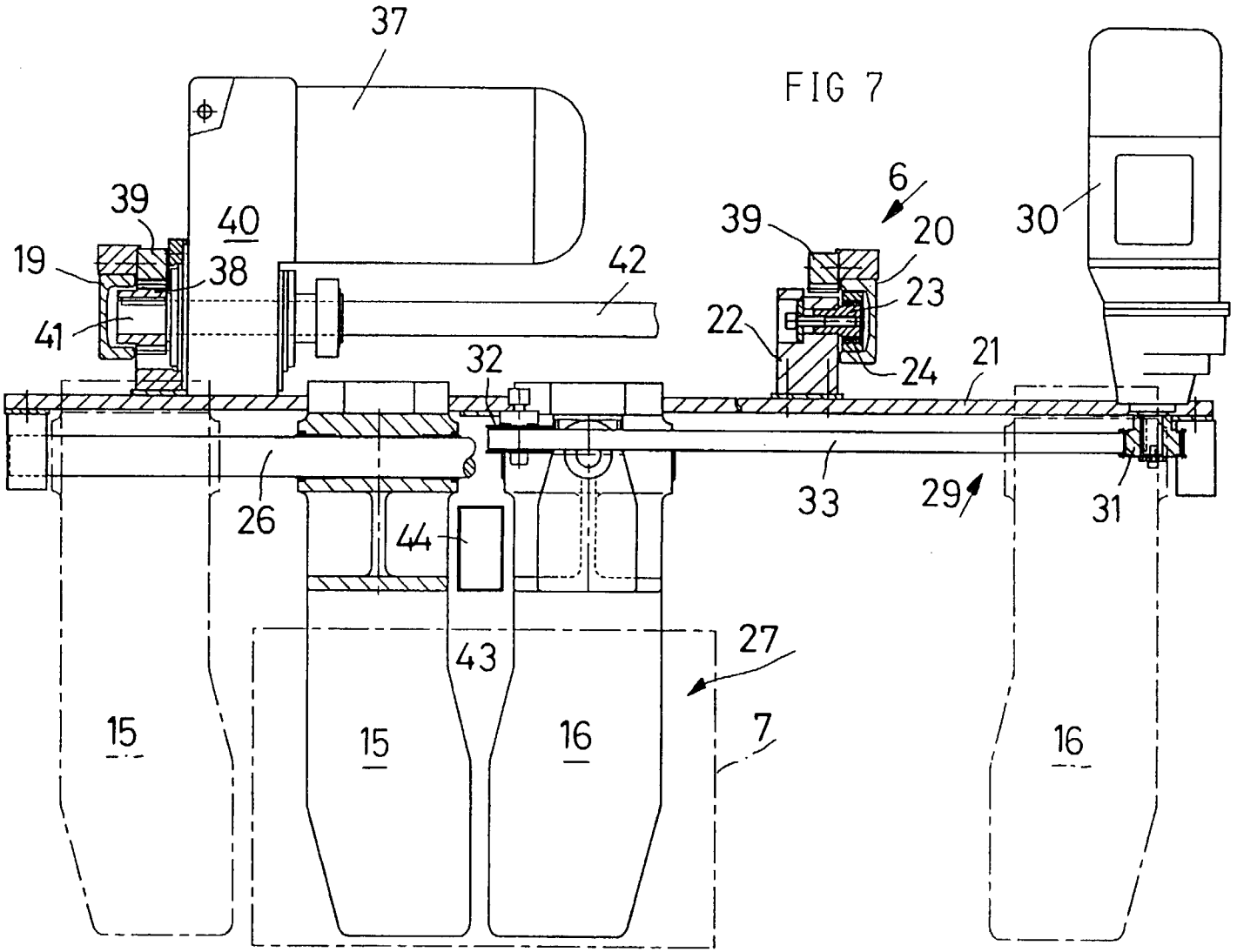
FIG. 7 is an enlarged cross-section through the device of the invention.

FIG. 7 illustrates an embodiment of the device 1 in accordance with the invention, particularly guide arrangement 6 and the drive and actuating elements.

Guide arrangement 6 comprises, among others, two yoke-shaped guide rails 19, 20, which are parallel and opposite one another and extend in the direction of stack formation. The guide rails are secured to a machine stand or base; support mechanisms 4 and 11 are seated so as to travel on these rails. For this purpose a table-shaped support 21 is provided, to which the drive and actuating elements are secured. An adapter 22 respectively screwed onto support 21 has an axle journal 23, on which a roller 24 rotates that extends into guide rail 20.

The guide arrangement 6 for support mechanisms 4, 11, which extends above and parallel to stack support 3, also functions as a suspension arrangement for the drive and actuating elements of the device of the invention.

The length of guide arrangement 6 at least nearly approaches the length of the production segment of a stack from the impact of the imbricated flow to the finished stack 7 at the end of a press 25. Supports 21 of support mechanisms 4, 11 project laterally from stack support 3 and have on their underside a guide rod 26, which extends transversely to the direction of movement of support mechanisms 4, 11 and is secured to the two lateral support ends. Respectively two downwardly-projecting jaw parts 27, 28 are seated to be laterally displaceable on the guide rod 26 of each support mechanism 4, 11; the lateral movement path of a jaw part 27, 28 is somewhat dimensioned by the vertical plane in the longitudinal center axis of stack support 3 up to the lateral edge of support 21. The guide rod segment associated with jaw part 28 for removing end plate 12 from hopper 13 is longer.

The lateral displacement of jaw parts 27, 28 on guide rod 26 is effected via a pulling drive 29 that is connected on the drive side to a motor 30. Pulling drive 29 respectively comprises a drive wheel 31 on the motor shaft and a toothed wheel 32 seated on jaw part 27, 28; the wheels rotate around vertical axes and are drive-connected by means of a toothed belt 33.

It is understood that at least partially pneumatic or hydraulic actuating means, such as plunger-cylinder units, can be used in place of a gear motor 30 and pulling drives 29 for lateral drive of the jaw parts, provided that these means are suited for synchronous drive.

Figure 8:
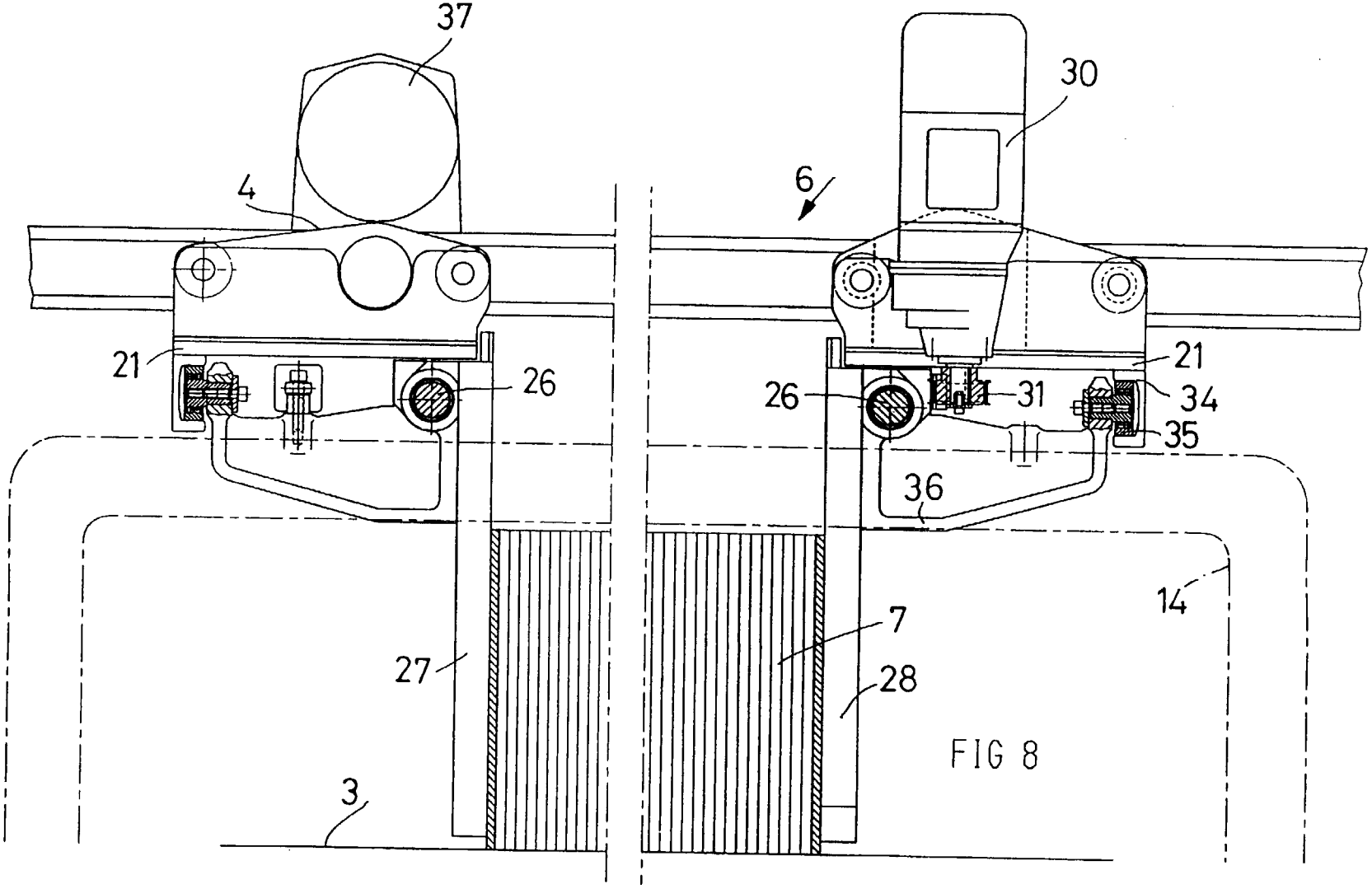
FIG. 8 is an enlarged longitudinal section through the device of the invention.

The stabilization of jaw parts 27, 28 with respect to the direction of movement is achieved—as shown in detail in FIG. 8—by means of a cantilevered element 36 that is connected to jaw part 27, 28 and has at its free end a running roller 35 which extends into a guide yoke 34, the guide yoke 34 on the underside of support 21 being secured to its side that extends transversely to the direction of stack movement. The transverse guidance of jaw parts 27, 28 is achieved by means of their (detachable) attachment to cantilevered element 36, which is displaceably seated on guide rod 26. A total of four of the possible drive units described above for lateral movement of jaw parts 27, 28, i.e. two drive units for each support mechanism 4, 11, is provided on guide arrangement 6 for the production of stacks 7.

Because of the belt that passes between jaw parts 27, 28 during simple tying, the individual jaw parts 27, 28 are configured by means of contiguous recesses above the stack 7, which is indicated by dash-dot lines; these recesses form a free space 43 for the upper band guide 44.

FIG. 7 illustrates the lateral end positions of jaw parts 27, 28 with a solid line on one side, in the stack formation position (inside), and on the other side in dot-dash lines in the return position of a support mechanism 4, 11 (outside), jaw part 28 having a further removed side position in the laterally displaced position for receiving end plates 12 from end plate hopper 13.

In FIG. 7, the longitudinal drive of support mechanisms 4, 11 above the stack formation is effected by means of a gear motor 37, which is disposed in a lying position, is secured to support 21 and meshes with a toothed rack 39 secured to guide rail 19.

An extension 42 of the shaft 41 of gear 40 that supports driving pinion 38 connects the drive pinion opposite the shaft and not shown with the guide rail 20 disposed mirror-inverted via an identical toothed rack 39.

The remaining structural details are imparted to one skilled in the art through FIGS. 7 and 8.

In FIG. 1 a tying device is disposed downstream of the stack-formation section on stack support 3. The tying device has a section of a belt guide 44 that extends approximately in the longitudinal axis of stack 7; the forward, vertical belt guide section 46 is configured to be lowered to allow the passage of the stack into the tying device. Tying belt 47 is removed from a drum 48 and hinged from below via a guide that surrounds stack 7, and welded at the ends.

The formed stack 7 can be tied once or multiple times with the present device 1, an option that can be implemented via the control of support mechanisms 4, 11 and printing plates 15 through 18.

It will be understood that the above description of the present invention is susceptible to various modifications, changes and adaptations, and the same are intended to be comprehended within the meaning and range of equivalents of the appended claims.

What is claimed is:

1. A device for forming and tying a stack of printed sheets with an end plate inserted at an end side of the stack comprising:

a conveying device for conveying the printed sheets in an imbricated flow vertically downwards;

an approximately horizontal stack support disposed below the conveying device and having an entrance end for receiving the printed sheets therefrom, the stack support having a working region where stacks of the printed sheets are formed, and, disposed downstream of the working region in a stack formation direction, a pressing region where formed stacks of the printed sheets are compressed;

a guide arrangement disposed above the stack support and including two support mechanisms displaceably driven between the working region of the stack support and the pressing region of the stack support, whereby, in the working region of the stack support, the support mechanisms serve as an insertion device for forming stacks by inserting an end plate at the end side of a respective stack of printed sheets, and, in the pressing region of the stack support, the support mechanisms serve as a jaw-type press for compressing a formed stack, the support mechanisms further being effective for conveying a formed stack from the working region of the stack support to the pressing region of the stack support; and a tying device operatively associated with the support mechanisms and disposed adjacent the pressing region of the stack support for tying a formed and compressed stack.

2. The device according to claim 1, further including a separating device disposed at the entrance end of the stack support and having a first part and a second part, the separating device being adapted to be inserted between two printed sheets whereby the first part thereof delimits a rear end of a formed stack, and the second part thereof delimits a front end of a stack to be formed immediately thereafter.

3. The device according to claim 2, wherein each of the first part and the second part of the separating device includes a separating element for separating the printed sheets, and a support element for supporting the printed sheets after they have been separated by the separating element, both the separating element and the support element being adapted to be raised into and lowered away from a region defined by the printed sheets.

4. The device according to claim 3, wherein a section of a separating element which extends into a stack is shorter than an imbrication spacing between two printed sheets.

5. The device according to claim 2, wherein the first part of the separating device is adapted to be moved away from the second part of the separating device.

6. The device according to claim 2, wherein the separating device is adapted to be driven from a resting position thereof at the entrance end of the stack support along the working region of the stack support and back to its resting position.

7. The device according to claim 2, wherein the separating device is driven synchronously with stack formation.

8. The device according to claim 1, wherein the stack support includes, at least in a forward portion of its working region, an endless belt adapted to be driven in the stack formation direction.

9. The device according to claim 1, further including a plate hopper disposed adjacent the working region of the stack support, and having end plates disposed therein, and the support mechanisms being configured to receive the end plates from the plate hopper for inserting the end plates at the end side of a stack of printed sheets.

10. The device according to claim 1, wherein the support mechanisms include pressure plates, and the guide arrangement includes drive means disposed above an upper edge of a formed stack for displacing the pressure plates transversely with respect to the stack formation direction.

11. The device according to claim 10, wherein the drive means include a drive element and guide rods operatively associated with the drive element for guiding the pressure plates to side regions of the stack support.

12. The device according to claim 11, wherein the drive element drives the pressure plates one of mechanically, pneumatically, hydraulically and electrically.

13. The device according to claim 11, wherein the drive means further include a support seated in the guide arrangement, the pressure plates being secured to an underside of the support.

14. The device according to claim 1, wherein the guide arrangement includes two guide rails disposed opposite one another and extending in the stack formation direction for receiving the support mechanisms.

15. The device according to claim 14, further comprising:

a gear motor operatively connected to the support mechanisms and having a drive pinion; and a toothed rack meshing with the drive pinion and being connected to one of the guide rails.

16. The device according to claim 15, wherein the gear motor includes two drive pinions secured to a common shaft, the device further comprising two toothed racks each of which meshes with a corresponding one of the two drive pinions and is connected to a corresponding one of the two guide rails.

17. The device according to claim 1, further comprising means for driving the support mechanisms individually in the stack formation direction.

18. The device according to claim 1, wherein the tying device is configured for at least one of single and multiple tying of a stack.

* * * * *